United States Patent [19]

Dixon

[11] 4,236,674

[45] Dec. 2, 1980

[54] SPRAY NOZZLE

[75] Inventor: George Dixon, Walsall, England

[73] Assignee: Binks Bullows Limited, West Midlands, England

[21] Appl. No.: 1,589

[22] Filed: Jan. 8, 1979

[30] Foreign Application Priority Data

Jan. 10, 1978 [GB] United Kingdom ..... 972/78

[51] Int. Cl.[3] ..... B05B 1/28; B05B 7/06

[52] U.S. Cl. ..... 239/296; 239/299; 239/424; 239/599

[58] Field of Search ..... 239/290, 296, 297, 299, 239/423, 424, 597, 599, 601

[56] References Cited

U.S. PATENT DOCUMENTS

| | | | |
|---|---|---|---|
| 584,864 | 6/1897 | Fisher | 239/424 X |
| 593,013 | 11/1897 | Fisher | 239/423 X |
| 2,587,993 | 3/1952 | Gray | 239/296 |
| 3,195,819 | 7/1965 | Watanabe | 239/290 X |

*Primary Examiner*—Andres Kashnikow

*Attorney, Agent, or Firm*—Holman & Stern

[57] ABSTRACT

An air atomizing liquid spray nozzle is characterized by a body having a generally elliptical outlet end defining a generally elliptical liquid outlet orifice and an air cap having a generally elliptical air outlet aperture concentric with and surrounding the elliptical outlet end of the body for causing a complementary annular elliptical pattern of compressed air to concentrically surround and impinge upon liquid flowing in an elliptical pattern from the outlet orifice and to directly atomize the liquid into a flat, fan-shaped spray pattern with reduced consumption of air and less noise than prior art nozzles.

2 Claims, 3 Drawing Figures

FIG.1.
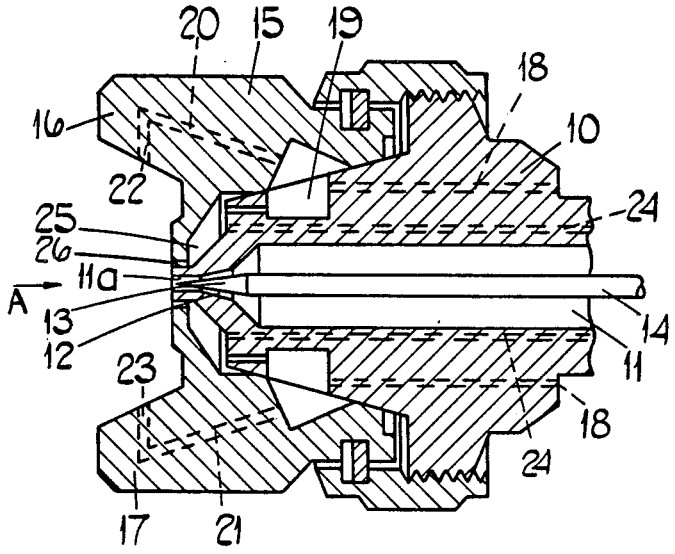
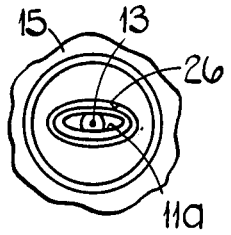
FIG.2.
FIG.3.
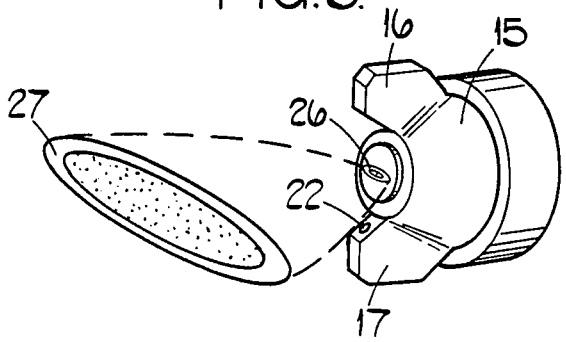

SPRAY NOZZLE

BRIEF SUMMARY OF THE INVENTION

This invention relates to a spray nozzle of the kind which is intended to be connected to a supply of a liquid which is to be sprayed and to a supply of compressed air whereby in use a spray of liquid will be emitted from the nozzle. The object of the invention is to provide an improved spray nozzle of this kind.

In accordance with the invention there is provided a spray nozzle comprising a body having a centrally disposed longitudinally extending aperture through which in use a liquid to be sprayed will flow and a cap which surrounds said body at that end thereof which in use includes the outlet end of said aperture, the body having passage means adapted to direct air into a cavity which is formed between said end of the body and the adjacent part of the interior of the cap and which has an air outlet, characterized in that the liquid aperture outlet and the cavity air outlet are each elongated in a direction perpendicular to the direction in which said liquid flows so that in use the liquid and the spray formed by mixing of the air and the liquid will flow from the nozzle in a pattern which has a generally flattened configuration in cross-section.

BRIEF DESCRIPTION OF THE SEVERAL VIEWS OF THE DRAWINGS

The invention will now be more particularly described with reference to the accompanying drawing wherein FIG. 1 is a fragmentary sectional elevation showing part of one example of a spray nozzle constructed in accordance with the invention.

FIG. 2 is an enlarged view, looking in the direction of arrow A on FIG. 1, of a part of the cap seen in FIG. 1, and FIG. 3 is a perspective view of the leading end of the nozzle seen in FIG. 1, showing the spray pattern which is produced in use by said nozzle.

DETAILED DESCRIPTION

Referring now to the drawing the example of a nozzle shown therein is intended for use in spraying paint or other liquid for which purpose said nozzle would be connected to a supply of the liquid and to a supply of compressed air. As shown in FIG. 1 the nozzle includes a body 10 having a centrally disposed longitudinally extending aperture 11 through which in use said liquid will flow. For a short distance near to its outlet end, said aperture 11 is shaped to a frusto-conical form 12 into which projects the frusto-conical end 13 of a needle 14 which can be displaced longitudinally under the control of an operator to vary the amount of liquid which can flow through said aperture 11, said needle 14 also being used when in its extreme leftward position as shown in FIG. 1 to close the outlet end of said aperture 11. Furthermore, the outlet end of the aperture 11 is elongated in a direction perpenduicular to the axis of the aperture to form a generally elliptical or oval outlet orifice 11*a*.

Surrounding the outlet end of said body 10 is a cap 15 which is formed with two forwardly extending projections in the form of opposed wings 16 and 17 which are spaced apart on a line perpendicular to the axis of elongation of said orifice 11*a*. The body 10 is formed with pasage means in the form of a plurality of passages 18 which at one end will be connected to the supply of compressed air and which at the other end will deliver such compressed air to an annulus 19 formed between said body 10 and the cap 15. Further passage means diagrammatically indicated by reference numerals 20 and 21 whereby air from said annulus 19 can flow into holes 22 and 23 formed in said wings 16 and 17. Thus streams of air flow from said holes 22 and 23 so as to be directed inwardly towards the center line of the nozzle. Air flowing from holes 22 and 23 is in fact conventionally used to shape a spray (such as a conical spray) emanating from a spray nozzle into a fan-shaped spray, but this air may be used in reduced volume or entirely dispensed with in using a nozzle according to the present invention.

The body 10 is also formed with passage means comprising a plurality of passages 24 which at one end are also connected to the supply of compressed air and which at the other end serve to deliver such compressed air into a cavity 25 formed between the outlet end of said body 10 and the adjacent part of the interior of said cap 15. The cap interior is shaped to turn the streams of air issuing from said passages 24 so that such streams are directed inwardly towards an aperture 26 formed in the center of said cap and the outer end of said body 10 also projects into this aperture whereby liquid flowing from the outlet end 11*a* of said aperture 11 of the body 10 will be able to pass through the aperture 26. As shown more particularly in FIG. 2 said aperture 26 is elongated in a direction perpendicular to the longitudinal axis of the nozzle so as to be of a generally elliptical or oval configuration concentric with and surrounding the orifice 11*a* of the liquid aperture 11, the direction of elongation being generally perpendicular to a line joining said wings 16 and 17 of the cap 15, as is the case with orifice 11*a*.

With the above described construction, liquid flowing along said aperture 11 will issue from the outlet end thereof in a generally flattened oval or elliptical pattern. Compressed air which will also flow through the aperture 26 from the cavity 25 will also have a complementary oval or elliptical pattern 27 and will surround and impinge upon the liquid flowing from the orifice 11*a* and atomise the same in the form of fan-shape configuration in cross-section as is more particularly illustrated in FIG. 3. Air issuing from the holes 22 and 23 formed in the wings 16 and 17 of the cap 15 will, if used, help further to flatten and shape said fan-shaped spray.

Thus air flowing from the cavity 25 will be mixed with the paint or other liquid as the latter flows from the orifice 11*a* so that the spray issuing from the nozzle will be atomised at this position and will be formed into a spray pattern having a generally flattened fan-shaped configuration in cross-section.

If further or subsequent shaping is to be achieved, air flowing from said holes 22 and 23 can be utilised far more efficiently than heretofore. Since the atomisation of the spray and at least the major part, if not all, of the desired shaping of the spray are carried out at a relatively early stage, i.e. as the spray emerges from the cap, relatively low pressure air can be used which not only considerably reduces the consumption of air but also makes for a very much quieter operation of the nozzle as compared with hitherto known nozzles.

I claim:

1. In a spray nozzle for spraying a liquid in a flat, fan-shaped spray pattern, the nozzle including a body with a central liquid aperture having an outlet end and a cap surrounding said body at the outlet end thereof, the body having passage means adapted to direct compressed air into an annular cavity which is formed between the cap and the body and which includes an air outlet surrounding the outlet end of the liquid aperture for causing compressed air to atomize liquid flowing from the liquid outlet, the improvement comprising a generally elliptical outlet end on the body defining a generally elliptical liquid outlet orifice and a generally elliptical air outlet aperture in the cap concentric with and surrounding the elliptical outlet end of the body for causing an annular elliptical pattern of compressed air to concentrically surround and impinge upon the elliptical pattern of liquid flowing from said liquid outlet orifice and directly atomize the liquid into a generally flattened, fan-shaped spray pattern with reduced consumption of air and less noise.

2. A spray nozzle as claimed in claim 1 wherein said cap has a pair of diametrically opposed wings which are spaced apart in a direction perpendicular to the direction of elongation of said elliptical air and liquid outlets, said wings having compressed air apertures for directing further air for shaping said liquid and spray flowing from the nozzle.

* * * * *